US005944113A

United States Patent [19]

Sundholm

[11] Patent Number: 5,944,113

[45] Date of Patent: Aug. 31, 1999

[54] SPRINKLER HAVING LIQUID SUPPLY PRESSURE BALANCE IN STAND BY MODE

[76] Inventor: Göran Sundholm, Ilmari Kiannon kuja 3, FIN-04310, Tuusula, Finland

[21] Appl. No.: 08/793,839

[22] PCT Filed: Sep. 12, 1995

[86] PCT No.: PCT/FI95/00495

§ 371 Date: Jun. 16, 1997

§ 102(e) Date: Jun. 16, 1997

[87] PCT Pub. No.: WO96/08291

PCT Pub. Date: Mar. 21, 1996

[30] Foreign Application Priority Data

Sep. 14, 1994 [FI] Finland ..... 944264

[51] Int. Cl.[6] ..... A62C 37/14

[52] U.S. Cl. ..... 169/37

[58] Field of Search ..... 169/37, 38, 39, 169/40, 41, 90

[56] References Cited

FOREIGN PATENT DOCUMENTS 501267 10/1994 Sweden .

92/15370 9/1992 WIPO ..... 169/37

93/21998 11/1993 WIPO .

94/06567 3/1994 WIPO .

94/16771 8/1994 WIPO ..... 169/37

94/25112 11/1994 WIPO .

*Primary Examiner*—Andrew C. Pike

*Attorney, Agent, or Firm*—Ladas & Parry

[57] ABSTRACT

A sprinkler has a body and a first nozzle on the body for spraying a liquid. The body also at least one second nozzle on the body for spraying the liquid at an oblique angle to the spraying of the first nozzle, an inlet in the body for receiving a supply of the liquid, and a spindle in the body for communicating with the inlet to stop the supply of the liquid from the inlet to the nozzles in a standby mode. The spindle is releasable for movement in a direction for releasing the supply of the liquid to the nozzles, and a release device on the body engages the spindle for releasing the movement of the spindle. Portions of the spindle are on opposite sides of the nozzle in the standby mode for at least partial balancing of pressure of the supply of the liquid from the nozzles on the spindle and, thereby, the release device.

10 Claims, 2 Drawing Sheets

SPRINKLER HAVING LIQUID SUPPLY PRESSURE BALANCE IN STAND BY MODE

The present invention relates to a sprinkler which in standby mode comprises a heat-sensitive releasing device in close contact with a spindle. More specifically, the invention relates to a sprinkler comprising a body provided with at least one nozzle, a liquid inlet, and a passage for supplying extinguishing medium to at least one nozzle, the sprinkler in standby mode comprising a heat-sensitive releasing device in close contact with a spindle displaceably mounted in a liquid passage with an inlet and an outlet to said nozzle.

The releasing device can be, for example, a glass ampoule which breaks at an elevated temperature. In order to ensure rapid release, it is desirable to make the ampoule as thin as possible. Even a thin ampoule resists a sufficiently heavy mechanical load if the load is exerted directly on the end of the ampoule and is even.

Swedish patent publication 501 267 discloses a sprinkler of this kind. However, the known sprinkler does not allow a high liquid pressure to prevail in the liquid inlet when the sprinkler is in standby mode, and therefore rapid release of the sprinkler is not possible. In this known sprinkler, a high liquid pressure would exert such a great force on the releasing device that the releasing device would break. In order to avoid breakage, the releasing device should have a special construction.

The object of the present invention is to provide a new sprinkler which ensures even and straight load on the releasing device; the load is not so heavy that the releasing device can break merely by the action of the liquid pressure when the sprinkler is in standby mode.

The sprinkler according to the invention is characterized in that the liquid passage consists of a channel against whose wall the spindle bears slidably or almost slidably, said spindle and channel extending to both (i.e., opposite) sides of the inlet of the channel for at least partial balancing of the liquid pressure at the inlet when the sprinkler is in standby mode, and that a nozzle centrally directed in relation to the obliquely positioned nozzles is provided at that end of the spindle which faces the releasing device.

Figure 3:
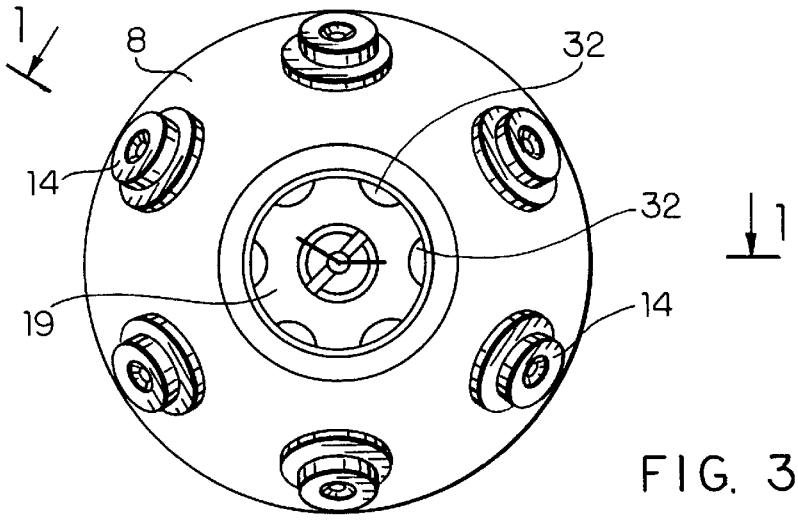
Figure 1:
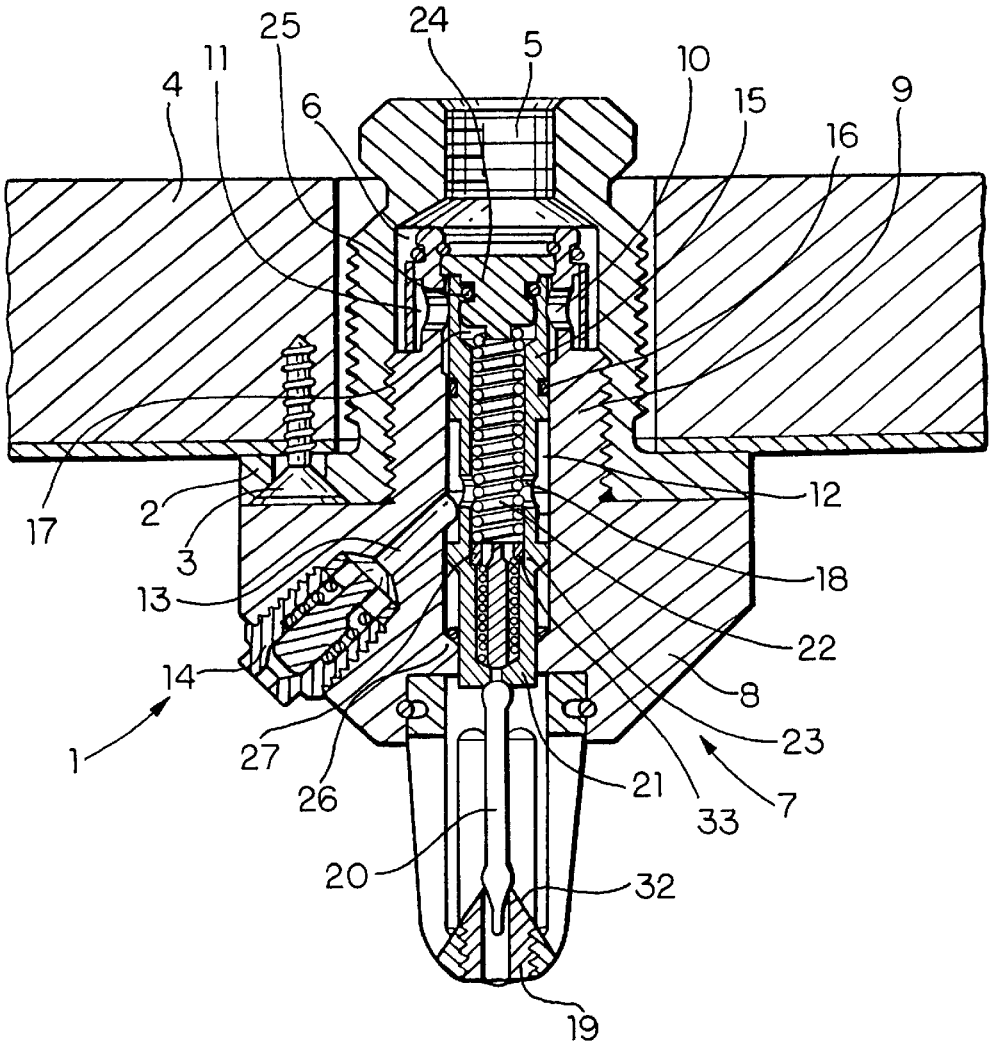
Figure 2:
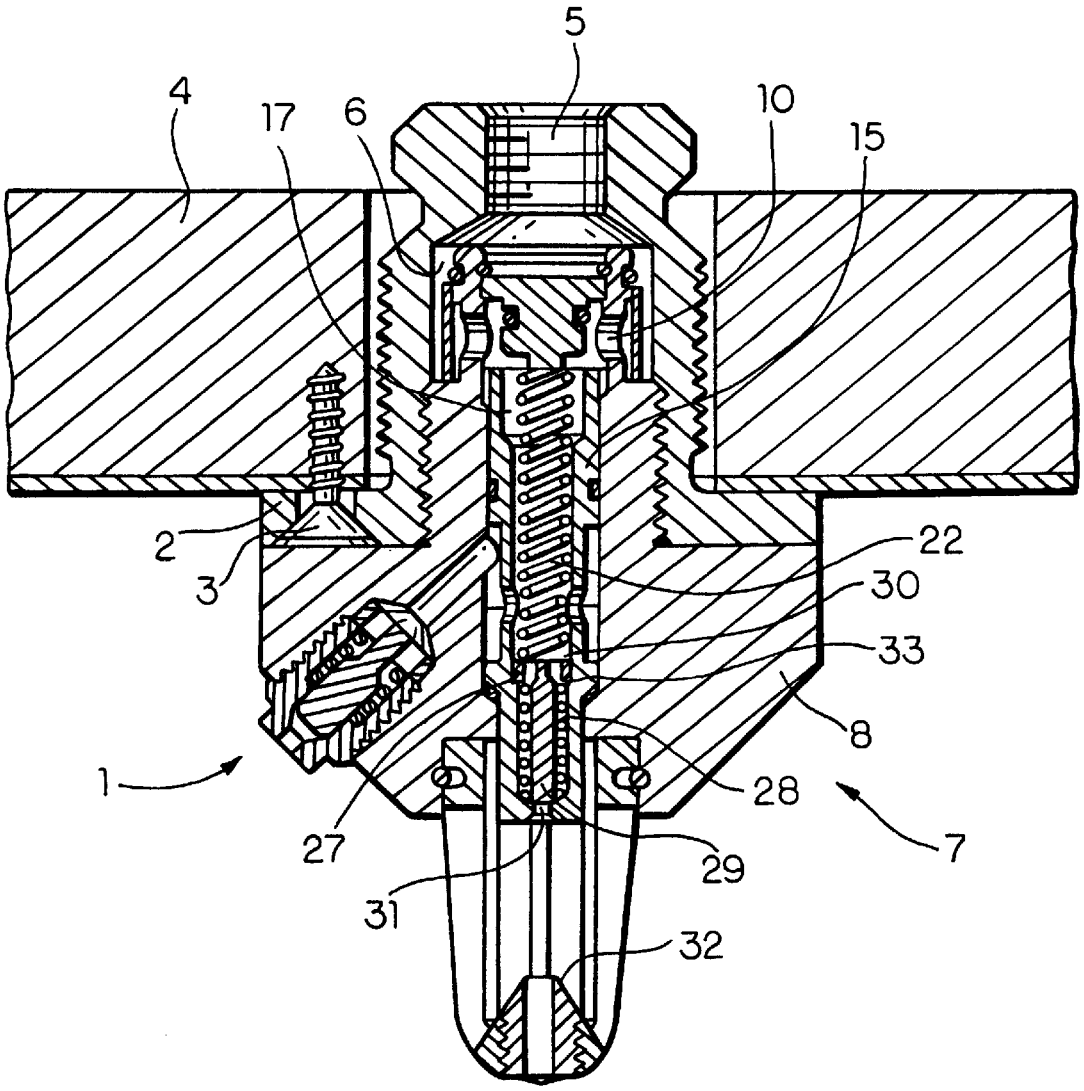

In the following, the invention will be described in greater detail with reference to an embodiment shown in the accompanying drawings, in which FIG. 1 is a longitudinal section on line 1—1 in FIG. 3 of an embodiment of the invention in standby mode, FIG. 2 is a longitudinal section similar to FIG. 1 in released mode, and FIG. 3 is a bottom perspective view of the embodiment of FIG. 1.

In FIGS. 1 and 2, reference numeral 1 denotes a sprinkler. The sprinkler comprises a sprinkler housing 2, which is secured to a ceiling 4 by a plurality of screws 3 only one shown; the sprinkler housing 2 is provided with a liquid inlet 5, which extends through the ceiling 4 and continues as a central channel 6. The sprinkler is further provided with an insert 7 comprising an insert housing 8 which is attached to the sprinkler housing 2, for instance, by means of a head 9 screwed in the central channel 6 and tightened against the sprinkler housing.

The head 9 of the insert housing 8 comprises a plurality of inlet openings 10 which are connected through a filter 11 to the liquid inlet 5 and which lead to a central channel 12 in the head 9. The central channel 12 branches off through branchings 13 to a plurality of obliquely positioned nozzles 14. A spindle 15 is slidably mounted in the central channel 12 of the insert housing 8. When the sprinkler is in standby mode, as shown in FIG. 1, the spindle 15 is sealed against the head 9 by means of a sealing 16 below the liquid inlet openings 10. The central channel 12 extends to both sides of the liquid inlet openings 10 to prevent the liquid pressure from exerting too great a downward force on the spindle 15 when the sprinkler is in standby mode.

The spindle 15 is also provided with a central channel 17 (hereafter: spindle channel) which below the spindle sealing 16 is connected via openings 18 to the central channel 12 of the head 9 and therefrom via the branchings 13 to the nozzles 14.

A holder 19 for a releasing device 20, e.g., an ampoule of a heat-sensitive glass-like material which softens and/or melts at an elevated temperature, is mounted on the bottom of the insert housing 8. The inner end of the ampoule 20 is fitted into the outer end portion 21 of the spindle 15, through which it is loaded by a spring 22 provided in the central channel of the spindle. The end of the spring 22 that faces the ampoule 20 bears against the bottom of the spindle channel 17 at a shoulder 33, whereas its opposite end bears against a plug 24 which is mounted in the head and sealed against the inside of the spindle channel 17 by means of an annular sealing 25. Alternatively, the shoulder 33 can be positioned higher in the spindle channel 17, and an adjustable stopper can be used instead of the plug 24.

The force of the spring 22 and the (typically very small) annular area of the sealing 16, on which the liquid pressure acts at the inlet openings 10, are dimensioned in such a manner that they do not break the ampoule 20 when its temperature is normal in standby mode as shown in FIG. 1. If the part of the spindle 15 that is located above the sealing 16 is in close contact with the surrounding wall of the head 9 on both sides of the inlet openings 10, the liquid pressure is in complete balance; only the spring 22 presses the spindle.

In standby mode illustrated in FIG. 1, there is, because of sealing 25, no liquid connection from the inlet openings 10 through the upper end of the spindle channel 17 to the nozzles 14; the direct connection is closed by sealing 16.

If the ampoule 20 breaks or at least softens because of hot gases or active heating by means of a heating coil (not shown) and yields under the force of the spring 22, as shown in FIG. 2, the spindle 15 strikes down until a shoulder 23 provided on said spindle interlocks tightly with a shoulder 26 provided in the insert housing 8. The spindle 15 moves a sufficiently long way to provide a connection for the liquid from the inlet openings 10 through the channel 12 in the head 9 past the sealing 25 to the spindle channel 17 and further to the nozzles 14 via openings 18 in the spindle 15. The nozzles 14 are preferably of such a type that they operate under high pressure and spray penetrating extinguishing liquid in the form of liquid fog in accordance with, for example, patent application PCT/FI92/00155 (i.e., WO92/20453).

Before the insert 7 is mounted, the ampoule 20 and the spindle construction 15, including the spring 22, are positioned in the insert housing 8. Thereafter the insert 7 is mounted in its entirety. It is thus easy to carry out careful mounting without damaging the ampoule, which is sensitive to shocks and uneven load.

The outer end portion 21 of the spindle 15, i.e., the end which faces the ampoule 20, is provided with a nozzle 27 having preferably the same basic construction as the nozzles 14 with a coil spring 28 around a nozzle pin 29. In the released position shown in FIG. 2, the liquid, in addition to flowing out through the nozzles 14, also flows from the spindle channel 17 through openings 30 in between and along the spirals of the spring 28 through a nozzle opening 31 and spreads through oblique spread surfaces 32 provided at the outer end of the holder 19.

The central nozzle 27 at the end of the spindle 15 ensures that there is no "hole" in the liquid fog produced by the sprinkler.

I claim:

1. A sprinkler comprising a body (2, 8) in which obliquely positioned nozzles (14) have been mounted, the body being provided with a liquid inlet (5) and a passage (6, 10, 12, 13) including a channel (12) with an inlet (10) and an outlet (13) for supplying extinguishing medium to the obliquely positioned nozzles (14), a spindle (15) comprising a spindle channel (17) and being displaceably mounted in the channel (12) of the passage, wherein the spindle (15) bears slidably or almost slidably against a wall of the channel (12) of the passage, a heat-sensitive releasing device (20) in close contact with the spindle when the sprinkler is in standby mode, and a centrally directed nozzle (27) centrally directed in relation to the obliquely positioned nozzles (14) at an end of the spindle (15) which faces the releasing device (20), wherein the spindle (15) and the channel (12) of the passage extend to both sides of the inlet (10) of the channel (12) of the passage for at least partial balancing of a liquid pressure at the inlet (10) of the channel (12) of the passage when the sprinkler is in the standby mode.

2. A sprinkler according to claim 1, and further comprising a plug (24) extending in the spindle channel (17) and a sealing (25) between the inlet (10) of the channel (12) of the passage and an inflow end when the sprinkler is in the standby mode, wherein the spindle (15) is arranged to be displaced so that the connection from the inlet (10) past the sealing (25) to an inflow end of the spindle channel (17) is opened when the sprinkler is released and wherein the centrally directed nozzle (27) is a direct extension of the spindle channel (17).

3. A sprinkler according to claim 2, wherein the sealing between the inlet (10) and a point of inflow of the spindle channel (17) comprises an annular sealing (25) mounted on the plug (24).

4. A sprinkler according to claim 3, and further comprising a spiral liquid channel defined by a coil spring (28) surrounding a nozzle pin (29) in a lower portion of the spindle channel (17).

5. A sprinkler according to claim 2, and further comprising a spring (22) in the spindle channel (17) bearing partly against a shoulder (33) in the spindle channel and partly against the plug (24) to displace the spindle (15) when the sprinkler is released.

6. A sprinkler according to claim 5, and further comprising a spiral liquid channel defined by a coil spring (28) surrounding a nozzle pin (29) in a lower portion of the spindle channel (17).

7. A sprinkler according to claim 2, and further comprising a spiral liquid channel defined by a coil spring (28) surrounding a nozzle pin (29) in a lower portion of the spindle channel (17).

8. A sprinkler according to claim 1, wherein the releasing device (20) is provided with a holder (19) having at least one obliquely positioned spread surface (32) outside an outlet opening (31) of the centrally directed nozzle (27).

9. A sprinkler according to claim 8, and further comprising a spiral liquid channel defined by a coil spring (28) surrounding a nozzle pin (29) in a lower portion of the spindle channel (17).

10. A sprinkler according to claim 1, and further comprising a spiral liquid channel defined by a coil spring (28) surrounding a nozzle pin (29) in a lower portion of the spindle channel (17).

* * * * *

UNITED STATES PATENT AND TRADEMARK OFFICE

CERTIFICATE OF CORRECTION

PATENT NO. : 5,944,113
DATED : August 31, 1999
INVENTOR(S) : Goran Sundholm

It is certified that error appears in the above-identified patent and that said Letters Patent is hereby corrected as shown below:

Title page, item [54] and col. 1, line 2, delete "STAND BY" and insert --STANDBY--.

Signed and Sealed this

Seventh Day of March, 2000

*Attest:*

*Attesting Officer*

Q. TODD DICKINSON

*Commissioner of Patents and Trademarks*